US006986552B1

(12) United States Patent
Sollami

(10) Patent No.: US 6,986,552 B1
(45) **Date of Patent: *Jan. 17, 2006**

(54) HARDENED ROTARY CUTTING TIP

(75) Inventor: Phillip A. Sollami, Herrin, IL (US)

(73) Assignee: The Sollami Company

( * ) Notice: Subject to any disclaimer, the term of this patent is extended or adjusted under 35 U.S.C. 154(b) by 4 days.

This patent is subject to a terminal disclaimer.

(21) Appl. No.: 10/720,722

(22) Filed: Nov. 24, 2003

Related U.S. Application Data

(60) Provisional application No. 60/516,886, filed on Nov. 3, 2003.

(51) Int. Cl.
*E21C 37/10* (2006.01)

(52) U.S. Cl. ..... 299/107; 299/111; 299/104

(58) Field of Classification Search ..... 299/111, 299/113, 112 T, 107, 105, 104
See application file for complete search history.

(56) References Cited

U.S. PATENT DOCUMENTS 4,627,665 A * 12/1986 Ewing et al. ..... 299/113
4,981,328 A * 1/1991 Stiffler et al. ..... 299/111
5,219,209 A * 6/1993 Prizzi et al. ..... 299/111
5,324,098 A * 6/1994 Massa et al. ..... 299/111
5,484,191 A * 1/1996 Sollami ..... 299/105
5,551,760 A * 9/1996 Sollami ..... 299/105
6,196,636 B1 * 3/2001 Mills et al. ..... 299/111
6,554,369 B2 * 4/2003 Sollami ..... 299/111

FOREIGN PATENT DOCUMENTS

SU 899916 * 1/1982

* cited by examiner

*Primary Examiner*—John Kreck
(74) *Attorney, Agent, or Firm*—Robert L. Marsh

(57) ABSTRACT

An insert for a cutting tool has a conical cutting tip, and axially behind the cutting tip is a mid-section. Behind the mid-section is a cylindrical base. Where the insert is for use on a tool of a milling machine, the base has a diameter of at least 0.800 inch so as to be considerably larger than the standard base of inserts currently in use on such machines. The enlarged base protects the tool body to which the insert is attached from washaway. The invention is useable in other industries employing rotary cutting tools. In other industries, the insert is made with an enlarged diameter base so as to protect the tool body behind the insert from erosion or washaway. Indentations in the outer circumference of the base improve the rotation of the tool and provide channels through which loosened particles of hard material are directed, thereby further reducing erosion of the tool body.

32 Claims, 8 Drawing Sheets

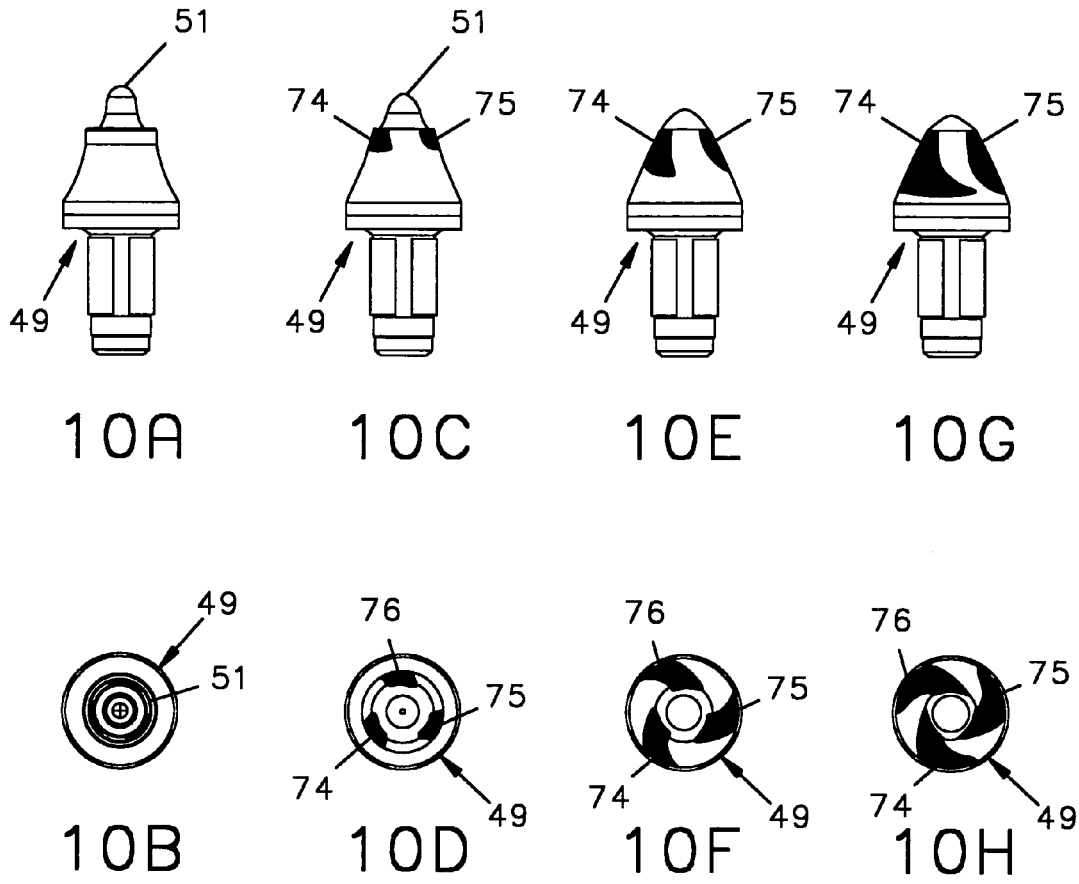
51
49
10A
51
74
75
49
10C
74
75
49
10E
74
75
49
10G
49
51
10B
76
75
74
49
10D
76
75
74
49
10F
76
75
74
49
10H

HARDENED ROTARY CUTTING TIP

The applicant claims priority from his provisional application filed Nov. 3, 2003 and assigned Ser. No. 60/516,886. The present invention relates to the cutting tips of rotary mounted tools and, in particular, to an improved tip which will prolong the useful life of the tool.

BACKGROUND OF THE INVENTION

Machines that remove the upper layer of pavement from a concrete road employ a plurality of cutting tools mounted on a drum, with each of the tools rotatable about its longitudinal axis. When such machines are employed to remove the upper surface of a road, the tools become worn and must be periodically replaced. Depending upon weather conditions, it may be necessary to replace the tools mounted on the drum of such machines daily, and sometimes twice daily. The drums of such machines typically mount more than one hundred of such tools, and therefore, the machines that remove the upper surface from a road must be removed from service for a lengthy period of time while the tools on the drum are replaced. The time loss that occurs while tools are replaced contributes significantly to the cost of resurfacing roads.

Similarly configured tools are used in trenching machines and rock saws for cutting grooves in concrete and the replacement of the tools on these machines increases the costs of operating these machines.

It is desirable, therefore, to extend as long as possible the useful life of the tools mounted on such machines. In order to extend the useful life of the tools, the manufacturers of such tools are engaged in a heated competition to find a configuration of a tool body with improved endurance to wear.

The tools mounted on such machines have an elongate metal body symmetric about a longitudinal axis and consist of a cutting end at the forward end of which is a seat for receiving a hardened tip, and behind the cutting end is an elongate cylindrical shank which is rotationally received in a cylindrical bore of a tool holder. The failure of such tools can be classified into certain clearly defined categories. First, tools may fail as a result of fracture of the hardened tip. Second, the braze that retains the hardened tip in the seat at the forward end of the tool may fail, such that the tip becomes dislodged from the tool. The tool may also fail because of washaway of the metal from which the tool body is made. Finally, a tool may fail because the hardened tip at the forward end of the tool has become dull and the tool can no longer effectively cut the hard surface against which the tools on the drum are directed. The manufacturers of such tools have been seeking a configuration of a cutting tip and tool body that will maximize the useful life of the tool.

One way of reducing the washaway of the steel bodies of such tools is to provide an enlarged tungsten carbide tip at the forward end of the tool. The most expensive portion of such tools, however, is the tungsten carbide from which the hardened tip is constructed and therefore providing a tool with an enlarged cutting tip greatly increases the cost of the tool. Furthermore, it has been found that a tool having an enlarged diameter tip will not maintain a sharp configuration for an extended period of time and therefore, although the tool does not suffer from washaway, it must be prematurely discarded when the cutting tip has become dull.

One configuration of a cutting tip which has had recognized success is disclosed by Ojanen, U.S. Pat. No. 4,497,520. The Ojanen tip has a tapered forward end, a generally frustoconical midsection that diverges gradually along its length, followed by an enlarged diameter base with a fillet between the frustoconical midsection and the base.

The enlarged diameter base of the Ojanen tip provided an enlarged surface area for bonding the tip into the seat at the forward end of the tool. During use, the material that forms the sharpened forward end of the cutting tip is gradually worn away. The elongate mid-portion of the tip gradually becomes shortened, but the outer diameter surrounding the sharpened portion of the tip remained substantially the same because of the gradual incline of the frustoconical mid-portion. As a result, even though material has eroded away from the surface of the tip, the tip generally remained relatively sharp and the tool continued to be useful as the carbide of the mid-portion is not worn away. It is not until the material that comprises the fillet between the midsection and the base begins to wear away that the tip will become dull and no longer useful.

In the meantime, however, existing tools employing tips embodying the configuration of the Ojanen tip have generally suffered greatly from washaway. Generally, long before a cutting tip embodying the configuration disclosed by Ojanen has become dull, washaway has so eroded the central body of the tool that the tool has acquired an hourglass configuration, and breakage of the tool body could occur between the base of the cutting tip and the shank.

On milling machines used to remove the surface of pavement, the tools are mounted on a rotating drum with the tools positioned on the drum to cut grooves in the surface of the asphalt or concrete with each of the grooves cut by the cutting tip of one of the tools. The tools of a milling machine are mounted on the drum in a spiral configuration and positioned to form grooves having a distance of approximately five-eighths inch between the center lines of adjacent valleys of the grooves with a solid ridge of material between the adjacent valleys of each of the grooves.

I have observed that it is the ridges between the valleys of the asphalt or concrete surface that are responsible for causing a great deal of the washaway that leads to the hourglass configuration of the tool body. It has thus been apparent to me that a tool body would be less subject to washaway if the tools could be configured so as to cut grooves in the hardened asphalt or concrete with less pronounced ridges. On the other hand, it would be desirable to provide a tip which would offer certain protection to the tool body behind the tip without greatly increasing the mass of tungsten carbide material from which the tip is made, such that the cost of the tip is not substantially increased.

BRIEF DESCRIPTION OF THE INVENTION

Since the machines used to cut hard surfaces employ numerous tools, tool manufacturers have continuously strived to minimize the cost of manufacturing the tool while maximizing the useful life thereof. Since the most expensive portion of such cutting tools is the tungsten carbide insert or tip fitted in the seat at the forward end of the tool, it is desirable that the mass of the tip be minimized. On the other hand, if the tool is manufactured with an undersized cutting tip, the tip will become worn away long before the tool body, thereby increasing the frequency with which the tools must be replaced and rendering the tool a less desirable product for such machines. Years of development of such tools have resulted in a standardization of the diameter of the base of the tungsten carbide tips or inserts at the forward end of the tools used in the milling industry of between 0.690 inch to 0.750 inch. The standardization of the base diameter of such tips or inserts occurred as the result of the efforts of manufacturers to reach that perfect balance in which the useful life of the tungsten carbide tip equals the useful life of the metal tool body on which the tungsten carbide tip is mounted. In similar fashion, the tips used at the forward end of the tools of trenching machines, and the tools for rock saws and the like have also become standardized over the years, where the standardization has occurred to maximize the useful life of both the cutting tip and the tool body in which it is mounted.

I have discovered, however, that providing a cutting tool having a carbide insert with an abnormally large diameter base will enhance the useful life of the tool because washaway of the tool body is reduced.

The advantages of the invention are best seen when studied with respect to the tools mounted on the drums of milling machines. The tools of such machines are mounted so as to engage the surface to be cut at an up angle of approximately 45 degrees and a side angle of about seven degrees. As a result of this orientation, the particles of hardened material loosened by the cutting tip will move along the body of the cutting tool and cause washaway which gradually erodes the tool body. One of the factors which causes the particles of loosened material to erode the tool body is the configuration of the grooves being cut by the tools. Existing tools cut somewhat parallel grooves with relatively high standing ridges between the valleys of the adjacent grooves. The ridges direct the loosened particles of hardened material towards the tool body after the cutting tip has cut the valley of the groove. The standing ridges are also contacted by the tool body of the trailing tool.

I have observed, however, that by providing an insert with a base having an enlarged diameter, the diameter being significantly larger than the standard 0.690 diameter for tips currently used in milling machines, the ridges formed between the valleys cut by the tips will be reduced in size. This occurs because a portion of the outer circumference of the base of the carbide insert breaks off peaks extending from the upper portion of the ridge thereby reducing the relative elevation of the ridges between the adjacent valleys. The reduction of the ridges alters the direction of loosened particles and directs them away from the metal body of the tools and reduces washaway of the tool body.

The tip or insert of the present invention consists of a tapered forward cutting end configured to cut the hard surface and axially align behind the forward cutting tip a mid-section, which diverges radially outward and rearward. The general configuration of the cutting end and the mid-section of insert or tip in accordance with the present invention are generally consistent with existing standards in the industry. Existing tips, for example, have an overall length from the forward end of the base to the forward end of the cutting end of approximately 0.625 inches and a diameter of the forward cutting end of approximately 0.375 to 0.425 inches. The mid-section of existing inserts normally diverges to a diameter of no more than about 0.480 inches.

Positioned axially behind the mid-section of the insert is a base with the outer surface of the base defining a cylinder. Where the insert is to be used at the cutting end of a tool for a milling machine, the base has an enlarged diameter of approximately 0.825 inches as opposed to a diameter of 0.690 to 0.750 inches of the prior art. Between the rearward end of the mid-section and the forward end of the base the insert of the present invention has a substantially planar surface.

In a more refined embodiment of the invention, the mid-section of the cutting tip is divided into a first mid-section portion and a second rearward mid-section portion, with the first mid-section portion being generally frustoconical in shape and the second rearward mid-section portion flaring outwardly such that the silhouette of the rearward second portion defines a curve.

The advantages of the insert of the present invention are further enhanced by providing a plurality of notches in the circumference of the base, the notches extending from the radially extending planar forward surface of the base to a rearward surface of the base such that the outer portion of the base is divided into a plurality of spaced flanges. The provision of the notches allows particles of hardened material loosened by the cutting tip to erode grooves in the tool body behind the cutting tip corresponding to the notches. The grooves in the tool body serve to channel particles of loosened material along the tool body without causing further washaway of the tool body. The grooves which become worn in the tool body may also facilitate rotation of the tool, thereby insuring that the cutting tip of the tool becomes evenly worn around the circumference thereof so as to maximize its useful life. The flanges that make up the outer portion of the base shield the remaining circumference of the tool body from erosion or washaway.

The peripheral portions of the enlarged diameter base provide a better mechanical advantage for supporting the base than has been available with prior art inserts, and as a result, there is a lesser incidence of failure at the braze joints. Also, the breaking strength of the insert can be further improved by providing a thicker base.

BRIEF DESCRIPTION OF THE DRAWINGS

A better understanding of the present invention will be had from a reading of the following detailed description taken in conjunction with the drawings, wherein:

FIG. 10A is a side-elevational view of the tool shown in FIG. 10 prior to incurring wear;

FIG. 10B is a front-end view of the tool shown in FIG. 10 prior to incurring wear;

FIG. 10C is a side-elevational view of the tool shown in FIG. 10A after it has incurred a small amount of wear;

FIG. 10D is a front view of the slightly worn tool shown in FIG. 10C;

FIG. 10E is a side-elevational view of the tool shown in FIG. 10A after it has incurred more wear than shown in FIG. 10C;

FIG. 10F is a front view of the partially worn tool shown in FIG. 10E;

FIG. 10G is a side-elevational view of the tool shown in FIG. 10A after it has become fully worn and in need of replacement;

FIG. 10H is a side-elevational view of the worn tool shown in FIG. 10G;

FIG. 19 is a side-elevational view of another insert embodying the present invention;

DETAILED DESCRIPTION OF A PREFERRED EMBODIMENT

Figure 1:
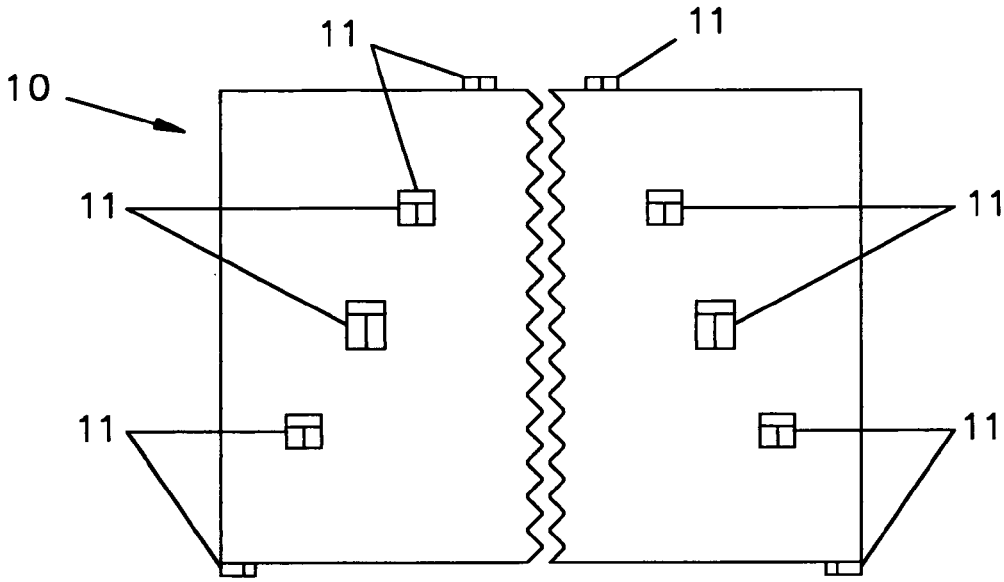
FIG.1 PRIOR ART
FIG. 1 is a schematic view of a drum of a milling machine having tool mountings for retaining tools thereon.
Figure 2:
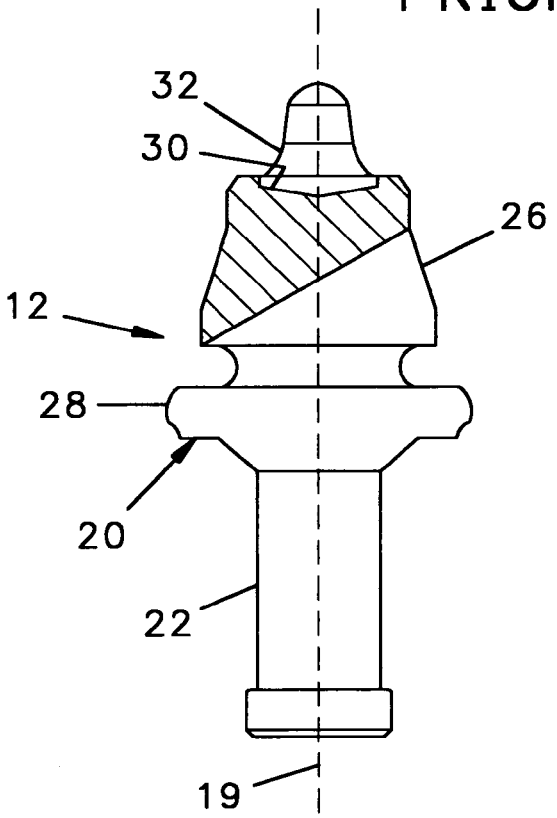
FIG.2 PRIOR ART
FIG. 2 is a side elevational view, partially in cross-section, of a tool in accordance with the prior art used on the drum of the milling machine shown in FIG. 1.
Figure 4:
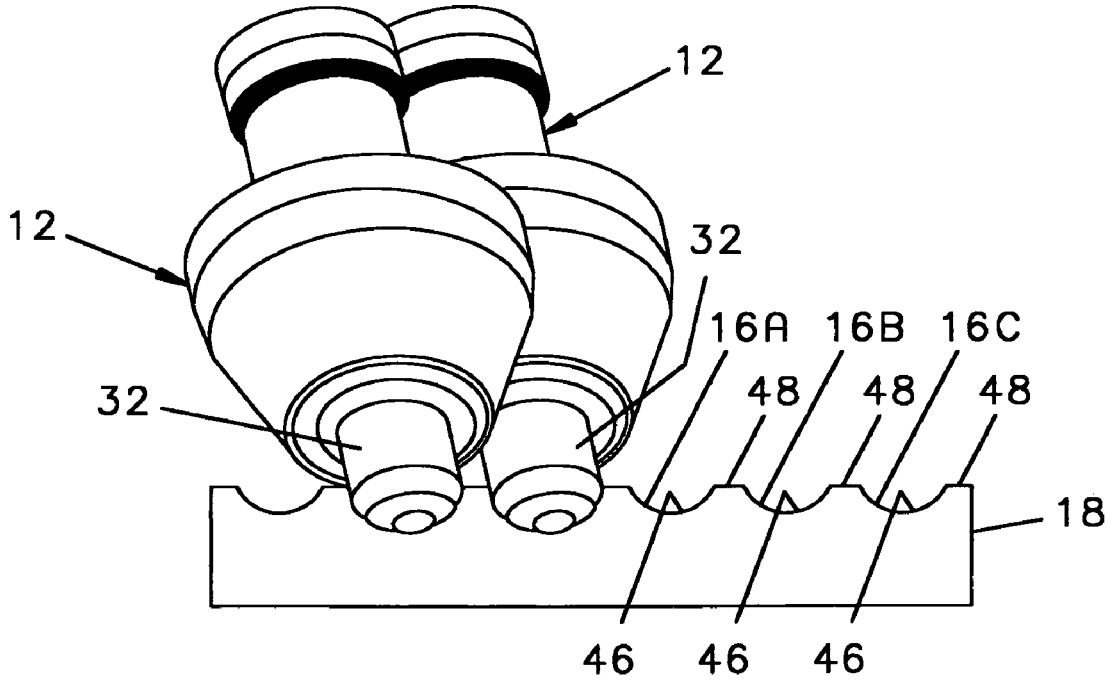
FIG. 4 PRIOR ART
FIG. 4 is a cross-sectional view of the grooves cut in a hard surface by prior art tools on the drum shown in FIG. 1.

Referring to FIGS. 1, 2, and 4, a milling machine employs a rotatable drum 10 on which are a plurality of tool mountings for mounting a plurality of cutting tools 12 with the cutting tools 12 positioned in a spiral around the circumference of the drum 10. Each of the tools 12 is mounted to the drum 10 such that the forward cutting end of the tool 12 will cut a groove in the hard surface 18 of the material such as concrete or asphalt. By mounting the tools 12 in a spiral around the circumference of the drum 10, the cutting ends of the various tools 12 are positioned to form a plurality of adjacent grooves 16A, 16B, 16C as the drum 10 rotates adjacent the hard surface 18.

Each of the tools 12 is mounted on the drum 10 to engage the hard surface 18 at an up angle of approximately 45 degrees and a side angle of seven degrees. The tools 12 are also retained in holders 11 on the drum 10 so as to be rotatable about the longitudinal axis 19 of the tool 12 such that the tool 12 wears evenly around the circumference thereof, thereby maximizing the useful life of the tool 12.

Referring to FIG. 2, a typical tool 12 for use in such machines includes a tool body 20 having a cylindrical shank 22 which is received in a complementarily shaped cylindrical bore in the holder 11 on the drum 10 for permitting the tool 20 to rotate about its longitudinal axis 19. The tool body 20 also includes a generally tapered cutting portion 26, and between the cutting portion 26 and the cylindrical shank 22 a radial flange 28. At the most forward end of the cutting portion 26 is a seat 30 into which is fitted a hardened cutting insert 32.

Figure 3:
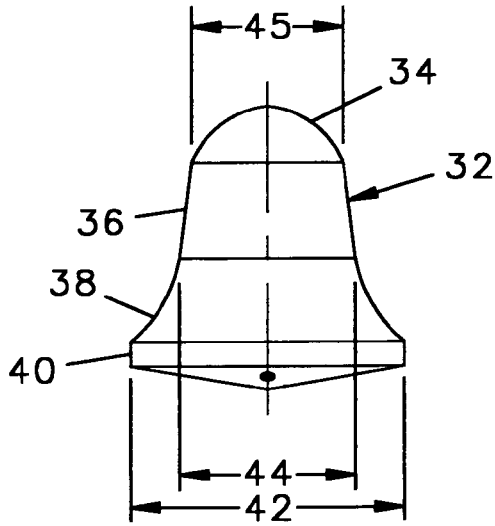
FIG.3 PRIOR ART
FIG. 3 is an enlarged side elevational view of the insert in the seat of the tool shown in FIG. 2.

Referring to FIG. 3, tools 12 of the type used in the milling industry have the seat 30 with a cylindrical inner wall with a diameter of approximately 0.700 inches. The cutting insert 32 that is received in the seat 30 has a forward cutting tip portion 34, and axially behind the cutting tip portion 34 is a tapered mid-portion 36. At the rearward end of the tapered mid-portion 36 is an outwardly diverging portion or fillet 38, and behind the fillet 38 is a cylindrical base 40. For existing milling machines, the cylindrical base 40 has an outer diameter 42 of approximately 0.700 inches. The fillet 38 of prior art inserts 12 extends to the outer diameter 42 of the base 40. The mid-portion 36 of the cutting tip 32 has a lower diameter 44, adjacent the fillet 38, of about 0.480 inches and the forward cutting tip 34 has a maximum outer diameter 45 of about 0.420 inches. Although the diameters of the mid-portions 36 and the diameter of the tip 34 may vary from one manufacturer to another, the greatest diameter 44 of the mid-portion 36 is about 0.480 inches and the diameter of the base is standardized at about 0.700 inches.

Referring further to FIGS. 1, 2 and 4, the tools 12 are mounted on the drum 10 to cut grooves 16A–16C in the surface 18 with each of the grooves 16A–16C having troughs 46 that are spaced apart a distance of five-eighths inch. Between adjacent troughs 46 are ridges 48 left standing after the successive cutting from the inserts 32 of the tool 12. I have found that the ridges 48 cause particles of hard material loosened by the tool 12 to be directed around the surface of the tool body 20 causing washaway of the metal of the tool body 20 and thereby causing the tool body 20 to become worn away more rapidly than the cutting tip 32 becomes worn. Often the tool body 20 becomes so worn away as to render the tool 12 unusable before the insert 32 has become fully worn, leaving an hourglass configuration to the tool body 20' shown in FIG. 5.

Figure 6:
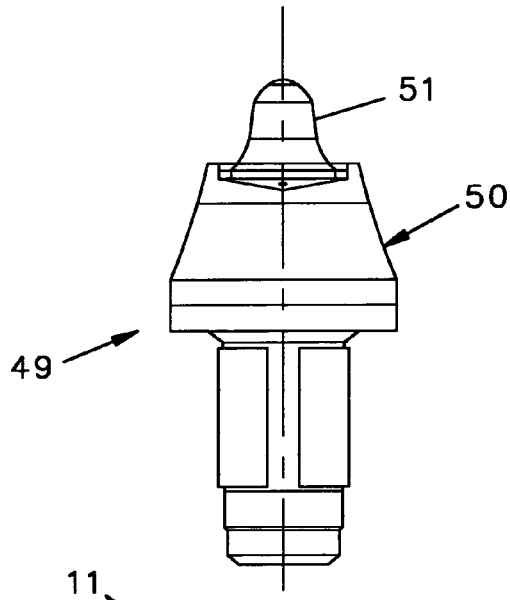
FIG. 6 is a side elevational view of a tool fitted with an insert in accordance with the present invention.
Figure 7:
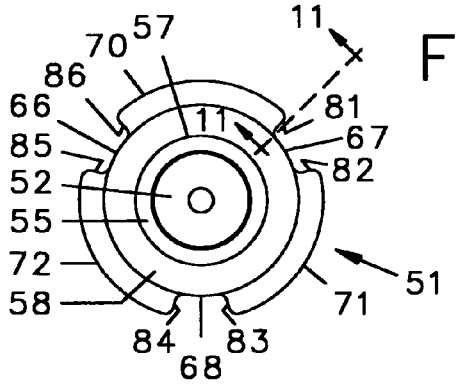
FIG. 7 is a front view of the insert fitted into the seat of the tool shown in FIG. 6.
Figure 8:
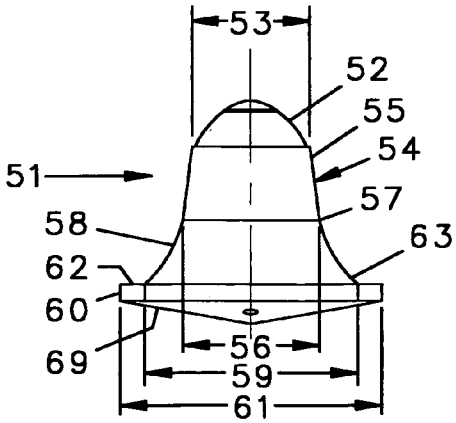
FIG. 8 is a side-elevational view of the insert shown in FIG. 7.

Referring to FIGS. 6, 7, and 8, the useful life of a tool can be increased by providing a tool 49 having a tool body 50 with an insert 51 in accordance with the present invention. The insert 51 has a tapered forward cutting tip 52 with a maximum diameter 53, and axially behind the forward cutting tip 52 is a tapered mid-portion 54. The mid-portion 54 may be divided into two sections, a forward section 55 which is typically frustoconical, tapering gradually from its forwardmost portion adjacent the maximum circumference 53 of the tip 52 to the lower end 57 thereof, and having a maximum diameter 56, and rearward of the forward section 55 is a rearward mid-section 58 which flares out from the intersection 57 with the forward mid-section to a maximum diameter 59. The cross-sectional dimensions of the diameters 53, 56, 59 respectively of the tip 52, the forward mid-section 55 and the rearward mid-section 58 are within the commonly accepted dimensions of the diameters 45, 44, 42 designated for the corresponding parts of the prior art inserts 32 described with respect to FIG. 3.

The inventive element of the insert 51 resides behind the rearward mid-section 58. Positioned axially behind the rearward mid-section 58 is a cylindrical base 60 having a diameter which is significantly larger than the diameter 42 of the insert 32 of the prior art. Preferably, for milling purposes, the cylindrical base 60 has a diameter 61 of 0.800 to 0.850 inch, but certain advantages of the present invention will be achieved by the provision of a cylindrical base 60 having an outer diameter larger than the 0.750 inch. Between the outer diameter 59 of the rearward mid-section 58 and the diameter 61 of the base 60 is a generally planar forwardly facing surface 62.

Figure 11:
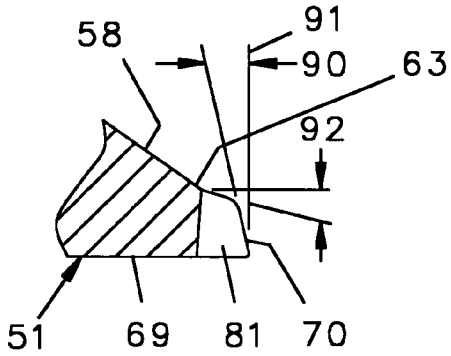
FIG. 11 is an enlarged, fragmentary, partially cross-sectional view of the insert shown in FIG. 7 taken through line 11—11 thereof.

Referring to FIGS. 8 and 11, to provide strength to the insert, a fillet 63 having a relatively small radius is provided between the rearward midsection 58 and the generally planar forwardly facing surface 62.

By providing a generally planar forward surface 62, the divergence of the rearward mid-section 58 is not overly accentuated and the outermost diameter 56 of the forward mid-section 54 can be manufactured so as to be within the 0.480 limits which is standard for cutting tips currently in use. An insert 51 in accordance with the present invention, therefore can be used to cut grooves 16A–16C in a hard surface and remain just as sharp during the cutting process as the cutting tips currently in use.

The enlarged diameter 61 of the cylindrical base 60 offers four desirable advantages that enhance the life of the tool 12 to which it is affixed. First, referring further to FIG. 9, the enlarged diameter 61 of the base 60 causes portions of the outer circumference of the base 60 to engage portions of the ridges 48' between troughs 46' of the grooves 16A'–16C', which are cut in a hard surface. The contact between the outer circumference of the base 60 and the ridges 48' reduces the elevation of the ridges 48' to a lesser level. By reducing the elevation of the ridges 48' between the troughs 46', the amount of loose particles directed toward the tool body 50 is reduced, thereby reducing the amount of washaway suffered by the tool body 50. A milling tool insert having a base diameter over 0.800 inch will cause a significant reduction in the elevation of the ridges 48' with respect to the troughs 46' in the groove made by a milling machine.

The second advantage of the enlarged diameter 61 of the base 60 is that the lower surface 69 of the base 60, which is retained by braze to the tool body 50, has greater surface area thereby improving braze adherence. The incidence of tool failure as a result of the insert becoming dislodged from the tool body is greatly reduced.

Figure 5:
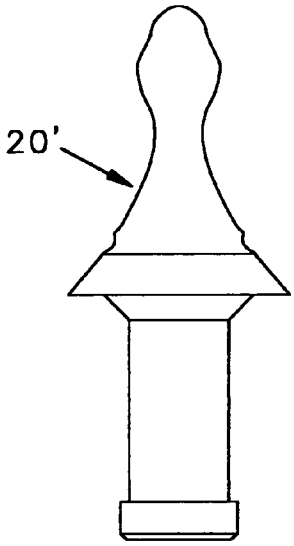
FIG.5 PRIOR ART
FIG. 5 is a side elevational view of a tool in accordance with the prior art that has suffered washaway of the tool body giving it an hourglass appearance.

The third advantage to the enlarged diameter 61 of the base 60 is that the base 60 provides a degree of protection, or shielding, to the tool body 50 and literally protects the tool body 50 from the washaway effects of loosened particles of hard material from the surface 18, and the tool body 50 does not acquire the hourglass configuration shown in FIG. 5.

The fourth advantage is that tool rotation is improved. As a tool body suffers washaway, the diameter of the tool body narrows reducing the leverage about the tool body axis of rotation and the tool is not as easily rotated as it is forced against a hard surface. Once a tool stops rotating, the tip of the tool will develop a flat which creates a resistance to rotation. A tool with a flat must be immediately discarded.

Referring further to FIGS. 7 and 8, although certain advantages are achieved by providing an enlarged diameter 61 for the cylindrical base 60, the benefits of the large diameter base 60 are maximized when the base 60 is provided with a plurality of notches or indentations 66, 67, 68 around the circumference thereof, with each of the indentations 66–68 extending from the generally planar upper surface 62 to the lower surface 69 of the base 60, without extending into the rearward mid-section 58, as shown. As a result of the indentations 66–68, the base 60 is broken into a plurality of flange segments 70, 71, 72 with each flange segment having an arcuate outer surface that defines a portion of a cylinder having a diameter 61.

It should be appreciated that although the lower surface 69 is depicted in FIG. 8 as being conical, the lower surface 69 may be planar, or semi-spherical, or a combination of shapes. The present invention relates to diameter 61 of the base 60 and to the intersection between the midsection 58 and the base 60, and not to the shape of the lower surface 69.

FIG. 11 depicts the upper surface 62 of the outer forward circumference of the base 60 as being blended into the mid-portion 58 by virtue of the fillet 63. This configuration maximizes the strength of the base 60 of the insert 51, but the advantages of the invention can still be achieved by an insert having a somewhat different configuration.

Figure 20:
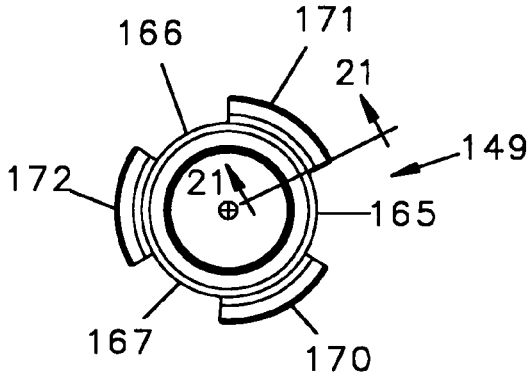
FIG. 20 is a front view of the insert shown in FIG. 19.
Figure 21:
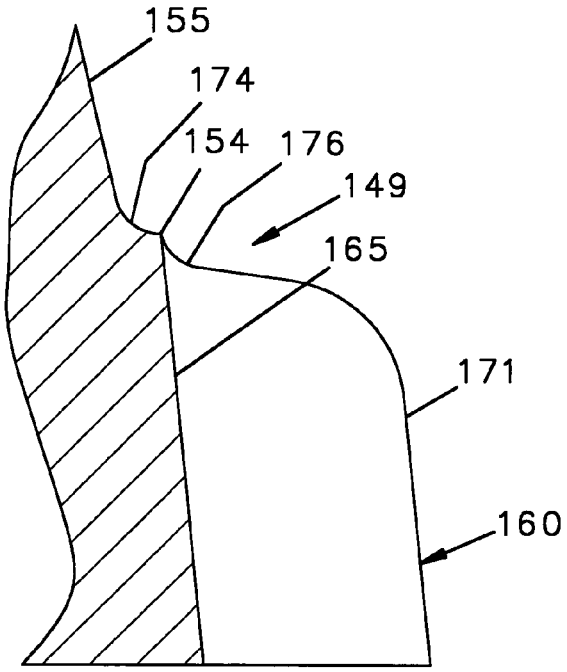
FIG. 21 is a fragmentary cross-sectional view of the insert shown in FIG. 19 taken through line 21—21 of FIG. 20.

FIGS. 19, 20, and 21 depict an insert 149 having a tapered cutting tip 152, a generally more robust, frustoconically shaped midsection 155 behind the cutting tip 152. Axially behind the midsection 155 is an enlarged diameter base 160. A shoulder 154 defines an inner circumference and arcuate indentations 165, 166, 167 in the base 160 have inner, generally vertical, surfaces that follow the curve of the shoulder 154. Between the indentations 165–167 are arcuate flanges 170, 171, 172, the outer edges of which define the maximum circumference of the insert 149. A first fillet 174 extends between the midsection 155 and the shoulder 154 and a second fillet 176 extends between the shoulder 155 and the flanges 170–172 of the base 160. In this embodiment the diameter of the midsection 155 is greater than the diameter of the forward section 55 of insert 51 described above and therefore the insert 149 will be subjected to greater transverse forces than insert 51. In order to bear the greater transverse forces the cross sectional area of the flanges 170–172, as determined by the thickness of the flanges and the arcuate length thereof, must be greater than the cross sectional area of the flanges 70–72 of insert 51. The flanges 170–172 therefore have a greater thickness than the flanges 70–72 of insert 51.

Figure 10:
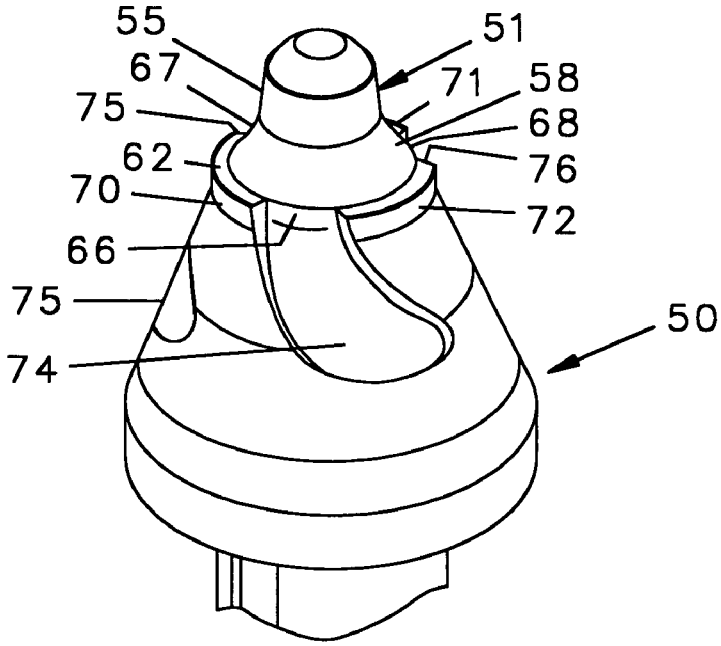
FIG. 10 is an isometric view of the forward end of a tool body fitted with the insert shown in FIG. 7 after the tool body has endured some wear.

Referring to FIGS. 10 through 10H, when a tool body 50 is fitted with an insert 51 in accordance with the present invention having a plurality of indentations 66–68 around the circumference of the base 60 thereof, usage of the tool will cause the metal of the tool body 50 to be washed away behind the indentations 66–68 causing a plurality of grooves 74, 75, 76 therein. This effect is explained in further detail in my U.S. Pat. No. 5,551,760 issued Sep. 3, 1996. The grooves 74–76 serve many purposes. First, the grooves assist in causing rotation of the tool body 50 in the cylindrical bore of the tool holder 11, thereby insuring that the tool body 50 wears evenly around the circumference thereof so as to maximize its useful life. Also, the grooves 74–76 provide channels for directing particles of material loosened by the insert 51 thereby enabling these particles of material to flow along the tool body 50 without causing the entire tool body 50 to suffer from significant washaway. The pattern of washaway that occurs during the useful life of the tool is shown in FIGS. 10A through 10H. As can be seen, the grooves 74, 75, 76 made into the surface of the tool body 50 as a result of washaway are not deep and as a result, the tool body 50 retains most of its mass and diameter through its useful life. The consequence is that the tool body 50 will not reach the hourglass configuration of prior art tools having inserts 20' as depicted in FIG. 5. Another benefit is that the tool 49 will continue to rotate during its useful life because the tool body 50 will maintain most of its diameter throughout its useful life.

Referring further to FIG. 7, it can be seen that the indentations 66–68 in the base 60 leave intact arcuate portions 70–72 of the base 60 with the arcuate portions 70–72 having arcuate outer edges that constitute approximately 50 percent of the circumference of the base. It should also be appreciated that the indentations 66–68 have surfaces 81, 82, 83, 84, 85, 86 which slope at an angle of about five degrees from the vertical. The sloping surfaces 81–86 have radiused corners that reduce the stresses in the arcuate portions 70–72 of the base 60, which would occur if the side wall between the indentations 66–68 and the flanges 70–72 formed sharp corners.

Referring to FIG. 11, the insert 51 is formed in a die and the formed insert must be removable from the die without damaging the surfaces of the insert 51. To remove the insert 51 from the die in which it is formed, vertical surfaces such as the outer surfaces of the arcuate flanges 70, 71, 72 and the curved surfaces 81–86 of the indentations 66–68 must have a gentle taper 90 of about five degrees with the perpendicular 91, such that the side surfaces are gradually reduced toward the forward or tip 52 of the insert 51 and larger towards the base 60. Also, the upper surface 62 of the flanges 70–72 that form the base 60 have been described as "generally planar" but not truly "planar." In order to remove the formed insert 50 from a die, the upper surfaces 62 cannot be planar and perpendicular to the axis 19 of the tool 49, but must have an incline 92 of about eight degrees, and therefore the upper surfaces cannot be truly "planar," but can only be nearly or "generally planar," as described above.

Figure 12:
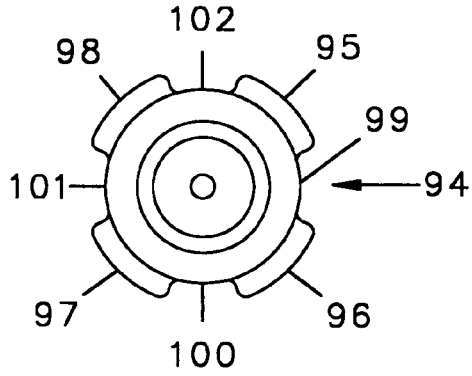
FIG. 12 is a front-end view of another insert in accordance with the invention showing a four-flange configuration.
Figure 13:
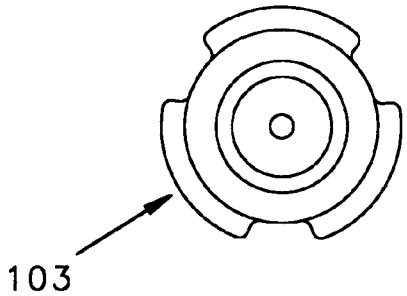
FIG. 13 is a front-end view of another insert in accordance with the invention, the insert having three flanges that scribe more than fifty percent of the circumference of the cylinder defined by the outer surface.
Figure 14:
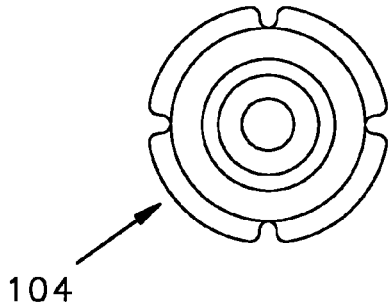
FIG. 14 is a front-end view of another configuration of flanges in accordance with the invention.
Figure 15:
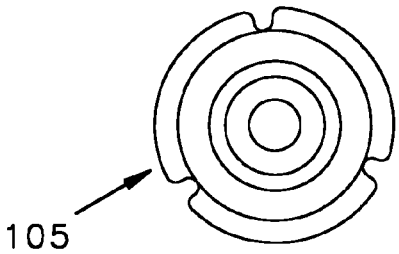
FIG. 15 is a front-end view of another configuration of flanges in accordance with the invention.
Figure 16:
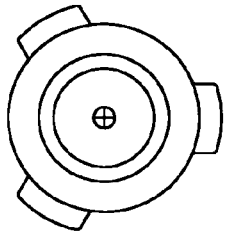
FIG. 16 is a front-end view of a configuration of flanges in accordance with the invention where the flanges scribe less than fifty percent of the circumference of the cylinder defined by the outer surface thereof.

Referring to FIG. 12, in the preferred embodiment, the arcuate portions of the base extend around approximately 50 percent of the outer circumference of the base. The insert 94 depicted in FIG. 12 has four flanges 95, 96, 97, 98 interrupted by indentations 99, 100, 101, 102, with the arcuate segments of the flanges 95–98 representing approximately 50 percent of the circumference of the cylinder defined by the arcs. Many of the benefits of the present invention, however, can be achieved where the arcuate portions comprise significantly less than 50 percent of the outer circumference of the base 60, or significantly larger than 50 percent of the outer circumference of the base. Referring to FIGS. 13, 14, and 15, inserts 103, 104, and 105 depict inserts having all the benefits of the invention with flange configurations in accordance with the invention where the flanges comprise more than fifty percent of the circumference of the cylinder defined by the segments of the base. FIG. 16, on the other hand, depicts a insert 106 with a configuration of flanges 111, 112, and 113 in accordance with the invention where the flanges occupy only about thirty percent of the circumference defined by their outer surfaces.

Figure 9:
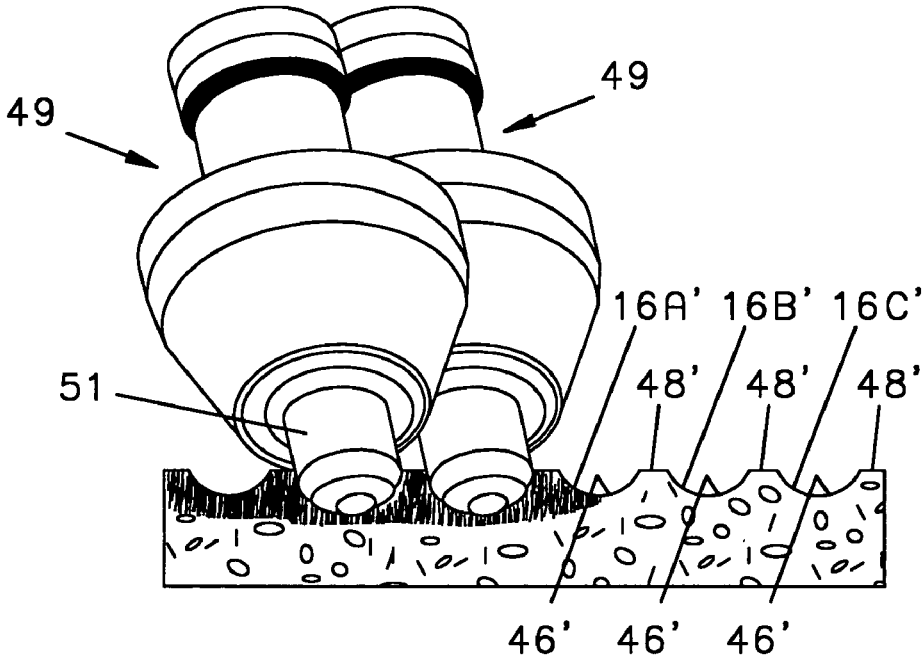
FIG. 9 is a cross-sectional view of the grooves cut in a hard surface by tools shown in FIG. 6 mounted on the drum shown in FIG. 1.
Figure 17:
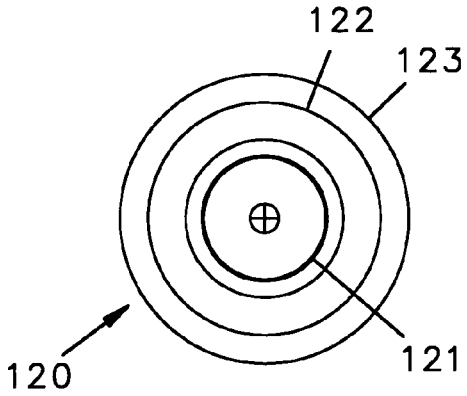
FIG. 17 is a front-end view of an insert in accordance with the invention that is without indentation in the base.
Figure 18:
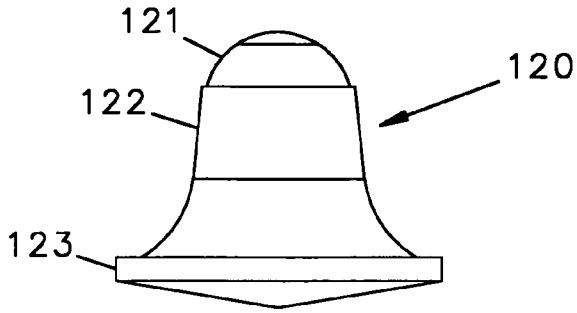
FIG. 18 is a side-elevational view of the insert shown in FIG. 17.
Figure 18:
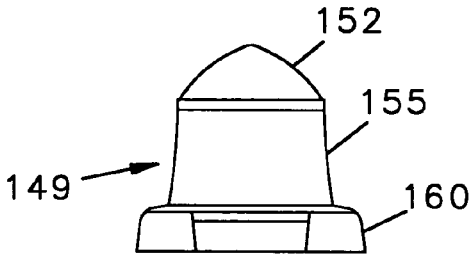

Referring to FIGS. 9, 17, and 18 it should also be appreciated that many of the benefits of the invention, specifically the reduction of the elevation of the ridges 48' between adjacent troughs 46' of the grooves cut in hard material will occur by providing an insert 120 which embodies many of the features of the invention. Specifically, the insert 120 has a conical forward cutting tip 121, a diverging mid-portion 122, having cross-sectional dimensions similar to those of the prior art and described with respect to the insert 51 above, and a cylindrical base 123. The base 123 does not have indentations or flanges, but scribes a full cylinder as shown. The cylindrical base 123 has an enlarged diameter, larger than the 0.690 diameter of the prior art inserts, such that the material of the enlarged diameter base 123 will, during use of a tool bearing the insert 120, engage the ridges 48' between adjacent troughs 46' breaking the tops of the ridges 48' and causing the ridges to be reduced in size. The enlarged diameter of the base 123 will also protect the tool body to which it is attached from washaway.

Figure 22:
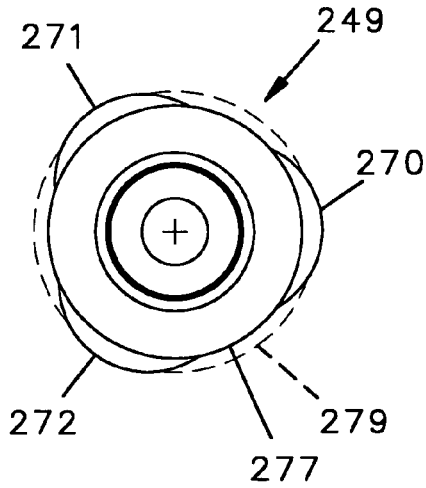
FIG. 22 is a front view showing another configuration of flanges on an insert in accordance with the invention.

Referring to FIG. 22, it should be appreciated that the outer edges of the flanges 270, 271, 272 of an insert 249 in accordance with the invention need not form segments of the same cylinder. The flanges 270, 271, 272 need only define a maximum outer diameter. I have found that an insert with a base having flanges 270, 271, 272 that define a larger diameter, as shown, achieve the benefit of the invention. Surprisingly, even though the area of the flanges 270–272 occupy only a small fraction of the area between the inner circumference 277 of the base and outer circumference 279, the braze holding the insert 249 into a seat will be nearly as strong as an insert with a solid cylindrical base equal to the maximum circumference 279 defined by base. This is believed to occur because the side surfaces 81–86 that define the indentations 66–68 provide additional surface area to which the braze attaches. It is also believed that the five degree taper of the nearly vertical side surfaces 81–86 to which the braze attaches further assists in retaining the insert 51 within the seat of the tool body 50.

Figure 23:
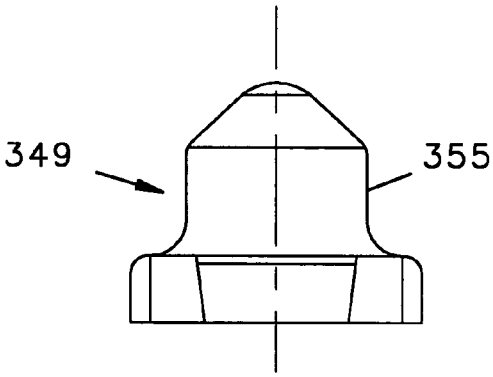
FIG. 23 is a side-elevational view of yet another insert in accordance with the invention.
Figure 24:
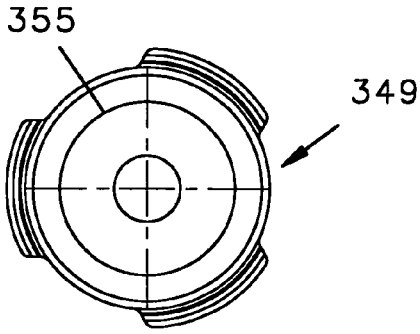
FIG. 24 is a front view of the insert shown in FIG. 23.

Referring to FIGS. 23 and 24, the midsection 355 of an insert 349 may also be cylindrical, as shown, without departing from the invention.

The invention has been primarily discussed with respect to milling tools, but the present invention has benefits when used in any cutting machines that employ cutting tools rotatable about their longitudinal axis.

Trenching machines use tools having inserts having appearances that are much like the insets used on milling machines; however, the inserts on trenching tools have larger dimensions including larger diameters than the inserts used on milling machines. The insert typically used on a tool for a trenching machine has a tip with a diameter of 0.750 to 1.000 inch, an elongate midsection behind the tip, and a cylindrical base behind the midsection. The inserts of such tools have profiles that look almost identical to the profiles of the inserts of a milling machine, but much larger. The bases of such inserts have an outer diameter of about 1.000 inch to 1.250 inch. The inserts for the cutting tools used in the trenching industry have bases that seldom exceed 1.250 inch in diameter.

By providing an insert to a trenching machine embodying the configuration described for FIGS. 7 and 8, advantages similar to those described with respect to milling tools will be achieved. A trenching tool having an insert with a base that is over 1.250 inch in diameter, perhaps 1.500 inch in diameter, will protect the tool body behind it against washaway in the same manner that the insert 51 protects the tool body 50 for a milling machine. Providing indentations and dividing the base into arcuate flanges as described with respect to indentations 66–68 and flange segments 70–72 will improve the rotation of the tool and further protect the tool against washaway.

The salt mining industry also employs cutting tools that are rotatable about their longitudinal axis and have tungsten carbide cutting inserts having configurations similar to that describe with respect to insert 51 and depicted in FIGS. 6 and 7. Salt is a softer media than asphalt or concrete and therefore the inserts used in the salt mining industry are correspondingly smaller. The rotatable tools employed in the salt mining industry, none-the-less, are subject to the force of erosion and tool failure similar to the erosion suffered by tools employed in the milling and the trenching industries. By providing a tool having an insert with a configuration as shown in FIGS. 6 and 7, and having a base with a correspondingly enlarged diameter, the enlarged base will protect the tool body supporting the tool against erosion or washaway.

While the present invention has been described with respect to specific embodiments, it will be appreciated that many modifications and variations may be made without departing from the true spirit and scope of the invention. It is therefore the intent of the appended claims to cover all such variations and modifications which fall within the true sprit and scope of the invention.

What is claimed is:

1. An insert for a cutting tool useable in a milling machine for cutting a plurality of parallel grooves in a hard surface, said parallel grooves having ridges between adjacent grooves, said cutting tool having a forward cutting end having a seat and a rearward cylindrical shank receivable in a cylindrical opening in a tool holder, said insert comprising a forward tip having an outer diameter, a mid-section behind said tip, said mid-section having a first diameter defined by said outer diameter of said forward tip and a second diameter rearward of said first diameter, a base axially behind said mid-section, a fillet between said mid-section and said base, said fillet having a maximum outer diameter, said base defining a cylinder having an outer diameter, and a forward surface extending outward of said fillet to said outer diameter of said base, said base having a plurality of radially outwardly extending projections where said projections are separated by indentations, said base, including said projections have nearly vertical side surfaces, said side surfaces forwardly tapering toward an axis of said insert at an angle of three to eight degrees to facilitate removal of said insert from a die used to form said insert.

2. An insert in accordance with claim 1 wherein said outer diameter of said base is greater than 0.750 inch.

3. An insert in accordance with claim 1 wherein at least a portion of said mid-section is cylindrical.

4. An insert in accordance with claim 1 wherein said arcuate flanges comprises approximately fifty percent of a circumference of said base.

5. An insert in accordance with claim 1 wherein said arcuate flanges have outer surfaces and said outer surfaces of said arcuate flanges are segments of a cylinder having a diameter equal to the maximum outer diameter of said base.

6. An insert in accordance with claim 1 wherein said surface extending outward of said fillet is nearly planar and sloping gradually rearwardly.

7. An insert in accordance with claim 6 wherein said surface extending outward of said fillet slopes downward at an angle of about eight degrees from a horizontal.

8. A cutting tool for use on a milling machine for cuffing a plurality of parallel grooves in a hard surface, said parallel grooves having ridges between adjacent grooves, said cutting tool comprising a tool body having a cutting end and a cylindrical shank, said cutting end having a seat at a forward end thereof, an insert bonded into said seat, said insert having a tapered cutting tip, a mid-section behind said tapered cutting tip, and a base behind said mid-section, said base defining an outer diameter, a fillet between said mid-section and said base, said fillet having an outer diameter less than said outer diameter defined by said base, and said insert further having a forward surface extending radially outward of said fillet and extending to said outer diameter defined by said base, and said forward surface sloping gradually rearwardly at an angle of about eight degrees from a horizontal.

9. A tool in accordance with claim 8 wherein said outer diameter of said base is greater than 0.750 inch.

10. A tool in accordance with claim 8 wherein said outer diameter of said base is large enough to engage one of said ridges between said grooves and wherein an elevation of said one of said ridges with respect to said grooves is reduced.

11. A tool in accordance with claim 8 wherein at least a portion of said mid-section is cylindrical.

12. A tool in accordance with claim 8 wherein said outer diameter of said base of said insert comprises a plurality of arcuate flanges and said arcuate flanges are separated by indentations.

13. A tool in accordance with claim 12 wherein said indentations extend radially inward of said outer diameter defined by said base but do not extend inward of said fillet.

14. A tool in accordance with claim 12 wherein said arcuate flanges comprises approximately fifty percent of a circumference defined by said base.

15. A tool in accordance with claim 12 wherein said arcuate flanges have outer surfaces and said outer surfaces of said arcuate flanges are segments of a cylinder having a diameter equal to the maximum outer diameter of said base.

16. A tool in accordance with claim 12 wherein said base, said flanges, and said insert have nearly vertical side surfaces, said side surfaces tapering toward an axis of said insert at an angle of three to eight degrees to facilitate removal of said insert from a die used to form said insert.

17. A rotary cutting tool for use on a cutting machine comprising a tool body having a cutting end and a cylindrical shank, said cutting end having a seat at a forward end thereof, an insert bonded into said seat, said insert having a tapered cutting tip, a mid-section behind said tapered cutting tip, and a base behind said mid-section, said base defining an outer diameter, a fillet between said mid-section and said base, said fillet having an outer diameter less than said outer diameter defined by said base, a forward surface extending radially outward of said fillet to said outer diameter defined by said base, said outer diameter of said base broken by a plurality of indentations forming radial flanges between said indentations, and said indentations having a minimum diameter greater than a maximum diameter of said fillet wherein said fillet does not extend into said radial flanges.

18. A tool in accordance with claim 17 wherein said arcuate flanges have outer surfaces and said outer surfaces of said arcuate flanges are segments of a cylinder having a diameter equal to the maximum outer diameter of said base.

19. A tool in accordance with claim 18 wherein said forward surface extending outward of said fillet slopes rearward at an angle of about eight degrees from a horizontal.

20. A tool in accordance with claim 17 wherein cutting machine is a trenching machine and said outer diameter of said base is greater than 1.250 inch.

21. A tool in accordance with claim 20 wherein said arcuate flanges comprise approximately fifty percent of a circumference defined by said base.

22. A tool in accordance with claim 20 wherein at least a portion of said mid-section is cylindrical.

23. A tool in accordance with claim 20 wherein said base, said flanges and said insert have nearly vertical said surfaces, said side surfaces tapering toward an axis of said insert at an angle of three to eight degrees to facilitate removal of said insert from a die used to form said insert.

24. A tool in accordance with claim 17 wherein said surface extending outward of said fillet is nearly planar and sloping gradually rearwardly.

25. A rotary cutting tool for use on a cutting machine comprising a tool body having a cutting end and a cylindrical shank, said cutting end having a seat at a forward end thereof, an insert bonded into said seat, said insert having a tapered cutting tip, a mid-section behind said tapered cutting tip, and a base behind said mid-section, said base defining an outer diameter, a fillet between said mid-section and said base, said fillet having an outer diameter less than said outer diameter defined by said base, a forward surface extending radially outward of said fillet to said outer diameter defined by said base, and said forward surface sloping rearward at an angle of about eight degrees from a horizontal.

26. A tool in accordance with claim 25 wherein said outer diameter of said base of said insert comprises a plurality of arcuate flanges and said arcuate flanges are separated by indentations.

27. A tool in accordance with claim 26 wherein said arcuate flanges have outer surfaces and said outer surfaces of said arcuate flanges are segments of a cylinder having a diameter equal to the maximum outer diameter of said base.

28. A tool in accordance with claim 25 wherein cutting machine is a trenching machine and said outer diameter of said base is greater than 1.250 inch.

29. A tool in accordance with claim 28 wherein said indentations extend radially inward of said outer diameter defined by said base but do not extend into said fillet.

30. A tool in accordance with claim 28 wherein said arcuate flanges comprise approximately fifty percent of a circumference defined by said base.

31. A tool in accordance with claim 28 wherein at least a portion of said mid-section is cylindrical.

32. A tool in accordance with claim 28 wherein said base, said flanges and said insert have nearly vertical said surfaces, said side surfaces tapering toward an axis of said insert at an angle of three to eight degrees to facilitate removal of said insert from a die used to form said insert.

* * * * *

UNITED STATES PATENT AND TRADEMARK OFFICE

CERTIFICATE OF CORRECTION

PATENT NO. : 6,986,552 B1
APPLICATION NO. : 10/720722
DATED : January 17, 2006
INVENTOR(S) : Phillip A. Sollami It is certified that error appears in the above-identified patent and that said Letters Patent is hereby corrected as shown below:

In column 6 line 4, after “shank 22” insert --is--

In column 9 line 38, after “and 105” delete “depict inserts”

In column 9 line 39, beginning of the line, delete “having”

In column 12, line 64, after “vertical” delete “said” and substitute --side--

In column 14 line 17, after “vertical” delete “said” and substitute --side--

Signed and Sealed this

Twenty-eighth Day of November, 2006

JON W. DUDAS
*Director of the United States Patent and Trademark Office*